US006499597B2

(12) United States Patent
Edwards et al.

(10) Patent No.: US 6,499,597 B2
(45) **Date of Patent: *Dec. 31, 2002**

(54) SKIN PACKAGE

(75) Inventors: David Brian Edwards, Ongar Essex (GB); William John McCarthy, Ongar (GB)

(73) Assignee: Aquasol Limited, Ongar (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 255 days.

(21) Appl. No.: 08/915,305

(22) Filed: Aug. 19, 1997

(65) Prior Publication Data

US 2001/0015330 A1 Aug. 23, 2001

Related U.S. Application Data

(63) Continuation of application No. 08/687,369, filed as application No. PCT/EP95/00292 on Jan. 27, 1995, now abandoned.

(30) Foreign Application Priority Data

Feb. 1, 1994 (GB) ..... 9401893

(51) Int. Cl.[7] ..... B65D 73/00

(52) U.S. Cl. ..... 206/460; 206/467; 206/471; 206/340

(58) Field of Search ..... 206/497, 467, 206/469, 470, 471, 340, 460, 338

(56) References Cited

U.S. PATENT DOCUMENTS

| | | | | | |
|---|---|---|---|---|---|
| 3,850,673 | A | * | 11/1974 | Nelson | 117/6 |
| 3,905,479 | A | * | 9/1975 | Gerner et al. | 206/469 |
| 3,924,746 | A | * | 12/1975 | Haines | 206/469 |
| 3,988,093 | A | * | 10/1976 | Birchenough | 425/174.4 |
| 4,106,621 | A | * | 8/1978 | Sorenson | 206/470 |
| 4,956,212 | A | | 9/1990 | Beckele | |
| 5,067,611 | A | * | 11/1991 | Hagmann et al. | 206/470 |
| 5,353,935 | A | * | 10/1994 | Yeager et al. | 206/470 |
| 5,460,267 | A | * | 10/1995 | Schiffer | 206/471 |
| 5,562,958 | A | * | 10/1996 | Walton et al. | 428/34.9 |
| 5,595,803 | A | * | 1/1997 | May et al. | 206/222 |

FOREIGN PATENT DOCUMENTS

| | | |
|---|---|---|
| DE | 4028652 | 4/1992 |
| EP | 0232931 | 8/1987 |
| EP | 0244084 | 11/1987 |
| EP | 0246897 | 11/1987 |
| EP | 0322199 | 6/1989 |
| EP | 0148170 | 7/1995 |
| FR | 2593152 | 7/1987 |
| GB | A922317 | 5/1963 |
| GB | 1091386 | 11/1967 |
| WO | WO8806558 | 9/1988 |
| WO | WO9300210 | 1/1993 |
| WO | WO9308091 | 4/1993 |
| WO | WO9308095 | 4/1993 |

* cited by examiner

*Primary Examiner*—Shian Luong
(74) *Attorney, Agent, or Firm*—Morgan & Finnegan, LLP

(57) ABSTRACT

This invention relates to a novel package, particularly for use as a skin package which may be readily recycled, and to a process for preparing such a package.

18 Claims, 4 Drawing Sheets

SKIN PACKAGE

Figure 1:
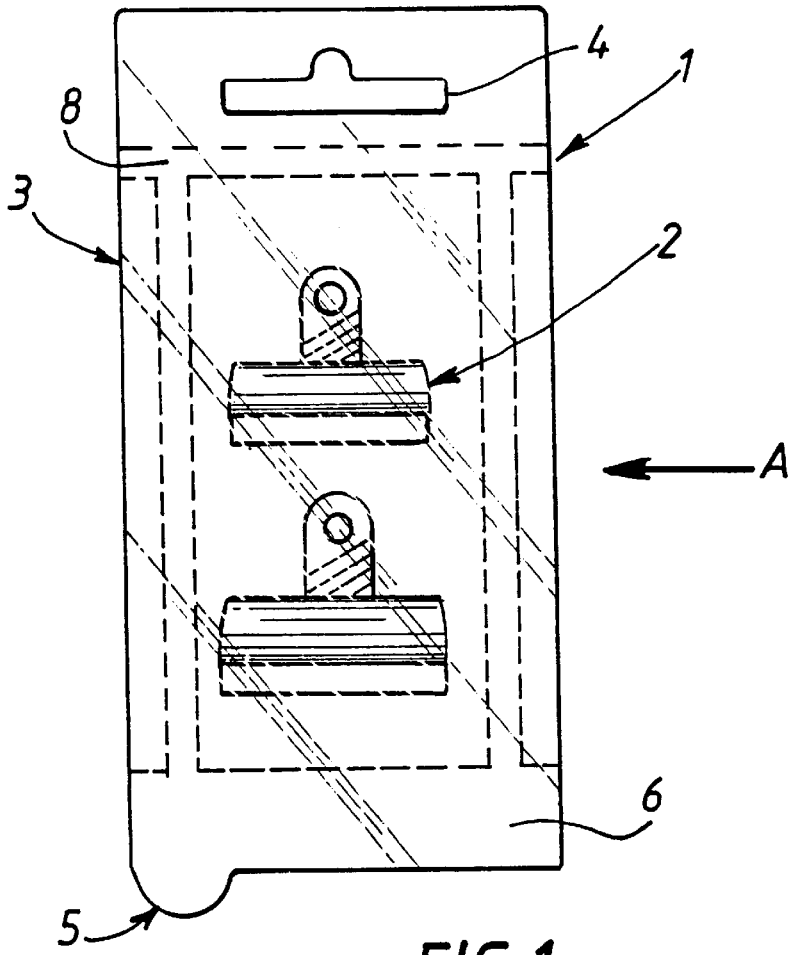
Figure 2:
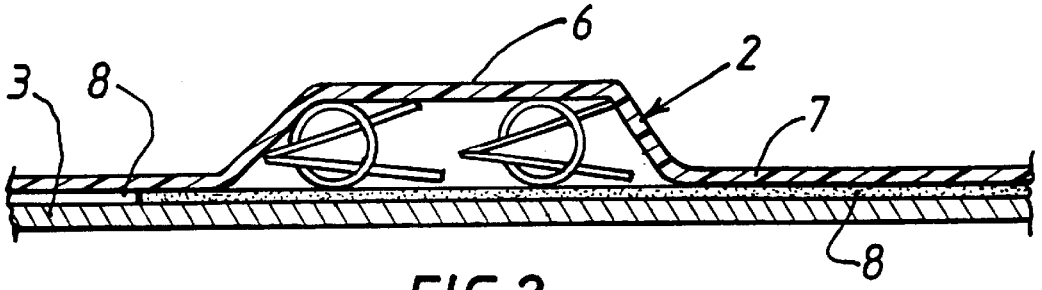
Figure 3:
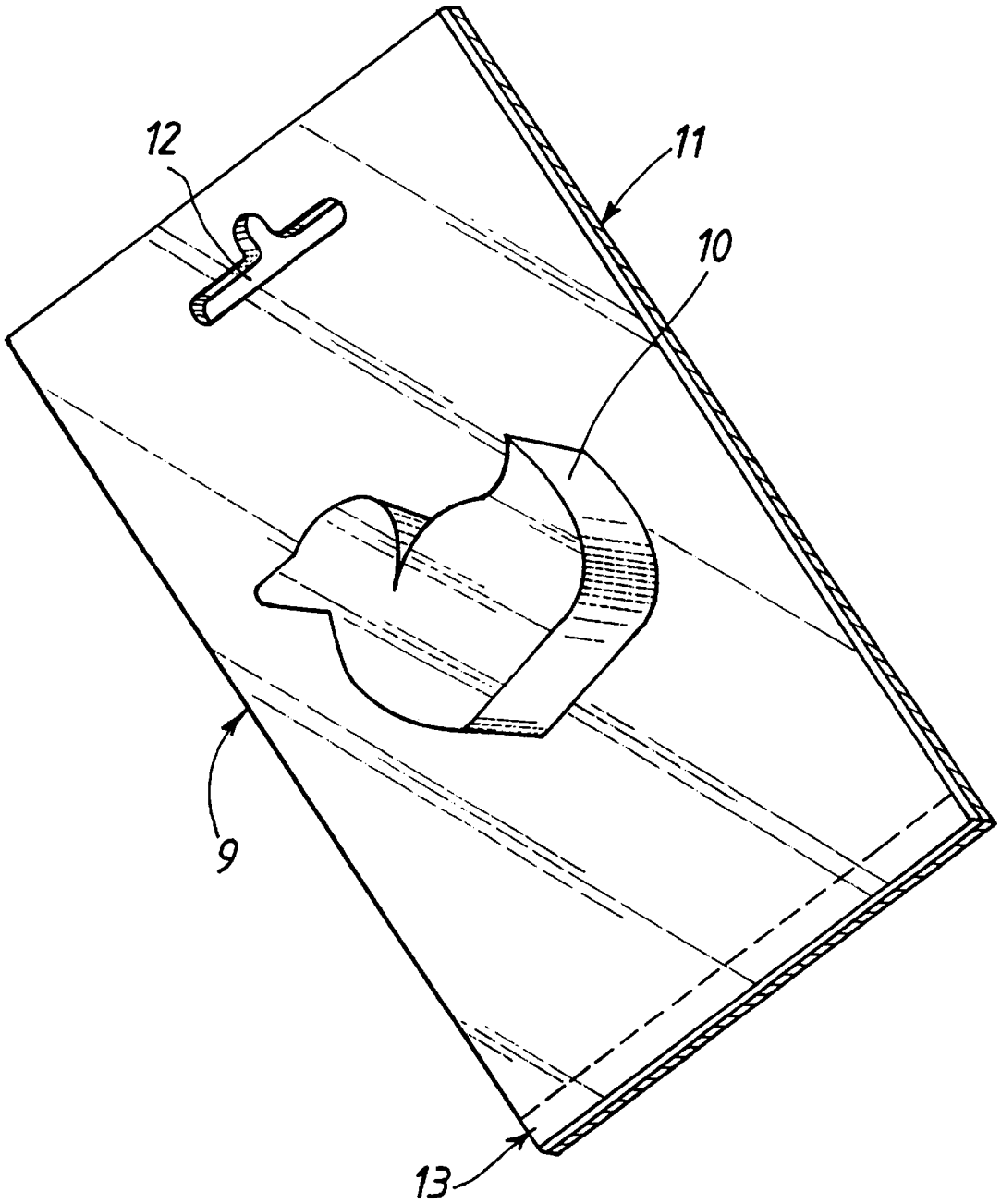
Figure 4:
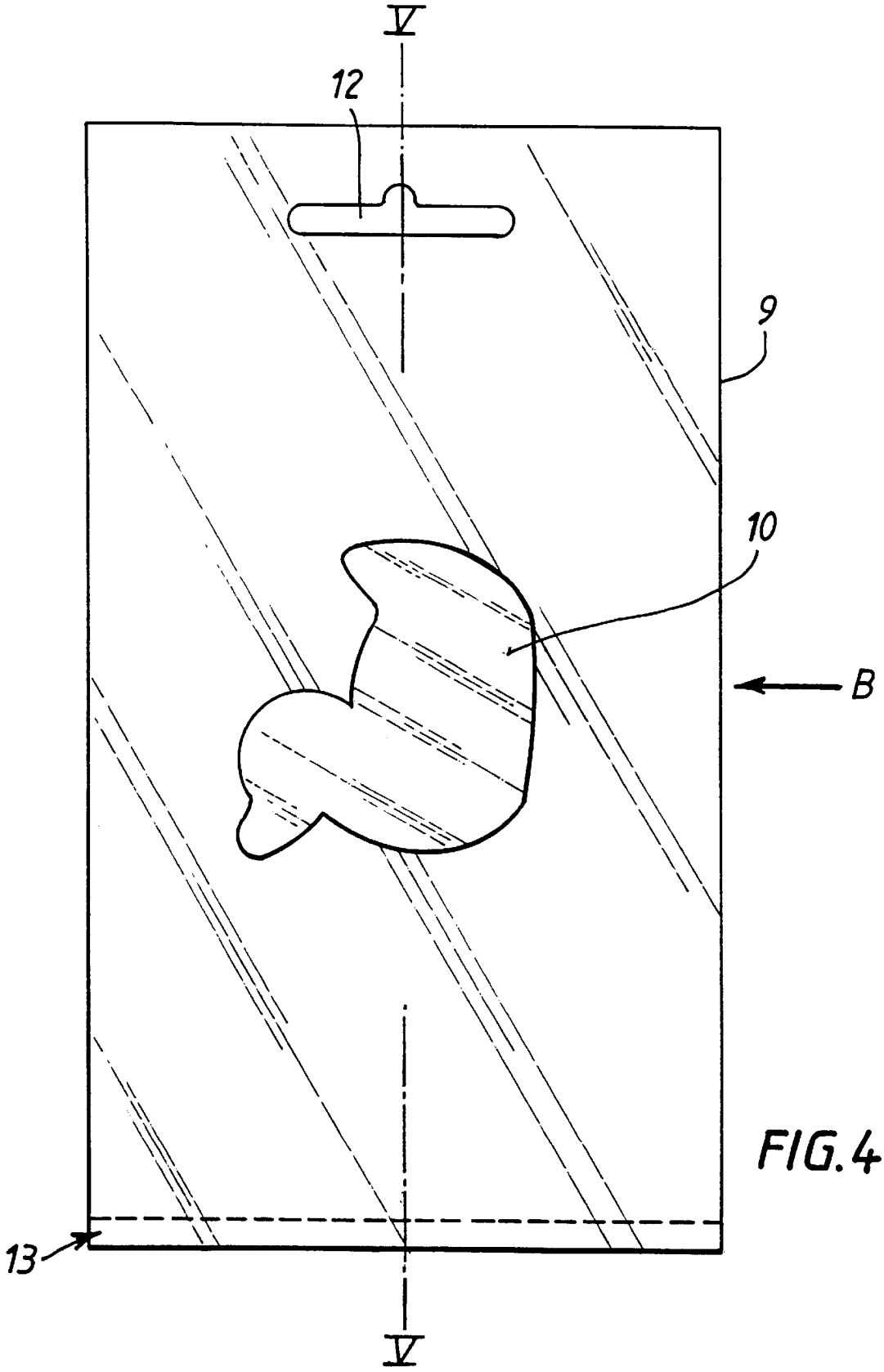
Figure 5:
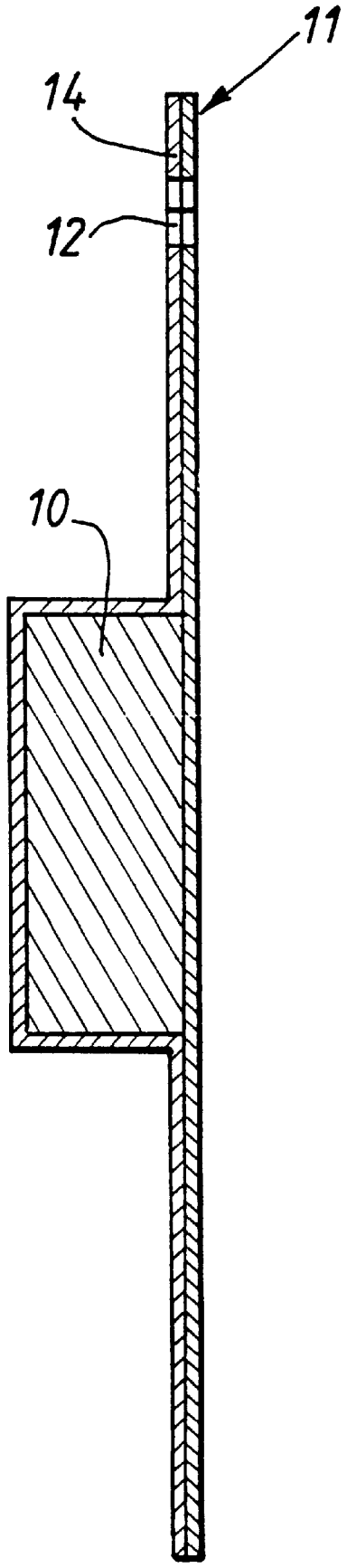

This is a continuation of application Ser. No. 08/687,369, filed on Oct. 7, 1996 abandoned which is a 371 of PCT/EP95/00292 filed Jan. 27, 1995.

This invention relates to a new package and a process for preparing the new package.

Skin packaging is a cheap, effective way of packaging a whole variety of goods, in particular where immediate point of sale is required. The packaging is convenient, relatively low in cost and typically tamper-proof, since in most cases it is immediately evident if the product has been tampered with. Many self-service stores such as supermarkets use this type of packaging to great extent.

Skin packaging involves the heating of a film to the point at which the surface of the film becomes hot and malleable. The heated film is drawn over an article to be contained, which rests on a board which is often coated with a heat sealable lacquer or varnish. Beneath the board air is drawn through its fibres, causing the heated malleable film sitting on the board to be pulled under pressure, forming a tight skin bonded to the surface above. The film, through heat and film distortion, is pulled over the article. Depending on the shape and size of the article, the film follows the contours of the article, causing a semi-rigid encapsulation of the article. This state is very desirable when packaging awkwardly shaped articles, for example screws, nuts and bolts. The product is thus held firmly in place.

A problem with known skin packages is that they cannot be readily disposed of. The skin film used is predominately made from "Surlyn" resin, a registered trade mark, which comprises an ionomer (ionomers are copolymers of ethylene and methacrylic acid which have been ionically cross-linked). Such films may not be readily recycled. For example a discarded package comprising "Surlyn" film may not be easily re-pulped.

In one aspect, the invention seeks to provide a package which can be recycled.

In another aspect the invention seeks to provide a package which is not static, for example it does not attract dust.

Thus the invention provides a package comprising a backing material having a first surface and a film of water soluble or water dispersible material having a sealing surface, portions of the first surface of the backing material and said sealing surface of said film being sealed with at least one article enclosed therebetween, characterised in that the backing material comprises a porous board.

Preferably the backing material is substantially planar. In particular the backing material preferably comprises a chipboard or, more preferably, cardboard. It will be understood that the surface of the board may be pre-treated to avoid undue absorption of adhesive, where present.

Suitable water soluble or dispersible materials include polyethylene oxide; more preferably a polyvinyl alcohol film is used. Such a polyvinyl alcohol film may be a partially or fully hydrolysed or alcoholised erg. 40–99% preferably 70–92% hydrolysed or alcoholised, polyvinyl alcohol film. The polyvinyl alcohol film may in fact be a co-polymer, with a second polymer replacing residual polyvinyl actetate. The film may be a cast film or, more preferably, a blown or extruded film.

The polyvinyl alcohol film may be unoriented, mono-axially oriented or bi-axially oriented. The film may be hot water soluble (e.g. it dissolves in water at a temperature from 40 to 100° C., preferably 40 to 50° C.) or preferably cold water soluble.

The water soluble or dispersible material may be mono-layered or in the form of a laminate, generally of two layers of different or preferably the same material. Typically the laminates will consist of two layers of thickness from 10 to 500 microns.

The film water soluble or water dispersible material which is sealed to the coating is typically of a thickness from 10 to 500 microns, preferably 20 to 150 microns, although it will be understood that the thickness will vary according to the article to be packaged and the film used.

The first surface of the backing layer and the sealing surface of the film may be sealed together in a number of ways. One preferred method is by forming a heat seal between the first surface of the backing material and the sealing surface of the film. Where this is the method, the first surface of the backing material must comprise a heat sealable material, e.g. polyvinyl alcohol or a paper material.

In another preferred aspect at least one of the first surface of the backing layer and the sealing surface of the film is coated with an adhesive, and portions of the first surface of the backing material are sealed to portions of the sealing surface of the film.

The adhesive coating preferably has a thickness from 1 to 10 microns, preferably from 1 to 5 microns.

The adhesive is preferably a thermally activated adhesive, water soluble or water dispersible adhesives being particularly preferred. In general the adhesive comprises a polymer. The adhesive preferably comprises polyethylene oxide or polyvinyl alcohol, polyvinyl alcohol being preferred. It is also preferred that the adhesive comprises the same material as the water soluble or dispersible material having the sealing surface, since they will be thermally active within the same temperature range as each other. Where the adhesive is thermally activated and comprises a different material from the water soluble or dispersible material having the sealing surface, preferably the film becomes malleable in the temperature range at which the adhesive is thermally activated.

Where the article to be packaged is inert to the adhesive, the adhesive may be provided on the film. This may be used for example where the article to be packaged is to be held in place and the adhesive and film may be readily peeled away from the surface of the article, for example metallic objects.

In a further preferred embodiment the backing material is provided with a region uncoated with adhesive between the article and the perimeter of the backing material, preferably running from where the package is to be opened (for example running from a pull tab). This offers advantages to the purchaser of the package, for example when releasing the contents of the package, by making the film more easy to peel.

According to a further feature of the present invention there is provided a process for the preparation of a package according to the invention comprising placing at least one article to be packaged on the first surface of a backing material, positioning a film of water soluble or water dispersible material over the first surface of the backing material, and sealing portions of the film to portions of the first surface of the backing material.

Generally the film is heated before being sealed to the surface of the backing material. Preferably the film is thermoformed before being sealed to the first surface of the backing material, typically at a temperature from 100 to 120° C. The backing material is generally placed under suction to draw the film to the surface, and for this reason the backing material may be provided with perforations to increase the suction.

In a preferred embodiment sealing may be accomplished using an adhesive, most preferably a water soluble or water dispersible adhesive. The adhesive is applied to at least one of the sealing layers of the film and the first surface of the backing material. The backing material is preferably coated with the adhesive prior to being sealed to the film.

The coating of water soluble or water dispersible adhesive is preferably applied to the backing material by a gravure process.

In another preferred embodiment, the sealing may be accomplished using a heat seal. A preferred way of providing the heat seal involves using a heated platten moving vertically and squeezing the surfaces to be sealed together under constant pressure and heat sealing around the perimeter of the article on the backing material. The dwell time of the platten in contact with the sealing surfaces will vary according to type of materials used and their thickness. Where the film is polyvinyl alcohol, the sealing temperature range is generally from 120 to 200° C., more preferably from 150 to 175° C.; and the dwell time is from 0.1 to 5 seconds, preferably from 0.5 to 1 second.

The package of the invention may be used to contain many different types of article. Some typical examples can be found in the packaging of automotive spares and spare parts and fittings across industry segments. Skin packaging of electronic circuit boards and electronic components sensitive to electrostatic discharge. This allows visual identification of components in handling without the risk of damage to the component. Since the packaging is recyclable, the invention could be used to hold powder type chemicals for concrete additives, the packaging of explosive components, the packaging of military ammunition to prevent corrosion, to resolve static problems and to permit easy disposal of the packaging, as both components of the skin packaging are pulpable. It is also well suited to packaging solid detergent chemicals, for example toilet disinfectants.

The following non-limiting example illustrates the invention. The following trade marks appear in the Example: Ad coat, Solublon, Vinex.

EXAMPLE

A manually operated Parnell SP4 Mark 5 Skin Packaging machine is used, which is capable of carrying boards of 425 mm by 275 mm. The heaters used are infra-red radiant lamps provided 100 mm above the surface of the board. A white lined chipboard of 700 to 800 micron thickness is placed on the surface of the machine. The board is coated with "Ad coat" SK528 polymeric adhesive (10.6 g per square meter, giving a thickness of approximately 4 microns) and when dry the article to be packaged (in this case a paper clip) is placed on the board. "Solublon KD", a 100 micron thick laminated film (two layers, each of 50 micron thickness), is placed manually over the top of the board and article, stretched fairly tightly, the heaters turned on and the film is heated to approximately 100° C. The board and article are raised to the heated film and suction applied to the underside of the board. This results in a skin packaged board. Other films which may be used include "Vinex 2144", a monolayered polyvinyl alcohol film having a thickness of for example 75 or 125 microns; or "Solublon KC" a monolayered polyvinyl alcohol film having a thickness of for example 100 microns.

The invention may be further illustrated with reference to the accompanying drawings in which:

FIG. I is a plan view of a package according to the invention;

FIG. II is a partially sectional side view of the package of FIG. I looking in the direction A;

FIG. III is a perspective view of another package according to the invention;

FIG. IV is a plan view of the package shown to FIG. IV;

FIG. V is a cross sectional view of the package shown in FIG. IV along the line II—II looking in the direction B.

Referring to the drawings FIG. I shows a package 1 containing an article 2 (in this case a pair of paper clips) which are mounted on a planar cardboard sheet 3. In the present case the board is provided with a cut-away portion 4 which allows the package to be hung on a display plinth. The package has a pull tab 5 to ease opening of the package as described below. The surface of the board bearing the article 2 is covered with a polyvinyl alcohol film 6 which is sealed to the board by an adhesive 7 (FIG. II, thickness not shown to scale) thus containing the article 2. The pull tab 5 in fact forms part of the film 6 and extends beyond the cardboard 3. The board 3 is provided with a region 8 which is not coated with polymeric adhesive which is the area within the dotted lines in FIG. I.

To open the package, a user lifts the pull tab 5 away from the board 3 whilst gripping the package 1 toward the end remote from the pull tab. Since the region 8 is not provided with adhesive 7 the film 6 peels easily away from the board 3. By continuing to pull the film 6 away from the board and towards the cutaway portion 4 the article 2 is exposed and may be removed from the package 1.

When the article has been removed from the package, the discarded packaging material may be recycled without any difficulties, as the film 6 may be readily re-pulped.

FIGS. III and IV show another package according to the invention 9, holding an article 10 (in this case a duck-shaped toilet disinfectant) which is mounted on a substantially planar backing layer 11. The package is provided with a hanging hole 12 which allows it to be held for example on a display plinth. The package includes a peelable region 13 to allow easy opening of the package and removal of the article 10.

As shown in FIG. V, the package comprises a planar backing layer 11, in this case made of polyvinyl alcohol and a film 14 which are sealed together in this case with a heat seal.

What is claimed is:

1. A package for enclosing an article comprising a backing component and a film component of water soluble or water dispersible material having an inner sealing surface, whereby portions of the backing component and the inner sealing surface of the film component being sealed to one another with the article enclosed therebetween for creating at least one sealed area and at least one area containing the article, such that the backing component includes a porous board, and an unsealed region on the board interposed by the sealed area such that the unsealed region is positioned to surround the article containing area for providing non-resistant peel away of the film component from the board.

2. A package according to claim 1 wherein the backing material is substantially planar.

3. A package according to claim 1 wherein the backing material is provided with perforations.

4. A package according to claim 1 wherein the backing material comprises cardboard.

5. A package according to claim 1 wherein the water soluble or dispersible material comprises polyvinyl alcohol.

6. A packaging according to claim 1 wherein at least one of said first surface and said sealing surface is coated with an adhesive, portions of the first surface of the backing material and said sealing surface of the film being sealed by said adhesive.

7. A package according to claim 6 wherein the adhesive has a thickness from 1 micron to 10 microns.

8. A package according to claim 6 wherein the adhesive is water soluble or water dispersible.

9. A package according to claim 6 wherein the unsealed region on the board is uncoated with the adhesive and the sealed area between the article and the perimeter of the backing material is coated with the adhesive.

10. A package according to claim 1 wherein portions of the first surface of the backing material and the sealing surface of the film are sealed by heat sealing.

11. A package according to claim 1 wherein the film has a thickness of from 10 to 500 microns.

12. A process for the preparation of a packaging according to claim 1 which comprises placing at least one article to be packaged on the first surface of a backing material, positioning a film of water soluble or water dispersible material over the first surface of the backing material, and sealing portions of the film to portions of the first surface of the backing material.

13. A process according to claim 12 wherein the film is heated before being sealed to the first surface of the backing material.

14. A process according to claim 12 wherein the film is thermoformed before being sealed to the first surface of the backing material.

15. A process according to claim 12 wherein portions of the first surface of the backing material and the sealing surface of the film are sealed together using an adhesive.

16. A process according to claim 15 wherein the adhesive is applied to the backing material by a gravure process.

17. A process according to claim 12 wherein portions of the first surface of the backing material and the sealing surface of the film are sealed together by a heat seal.

18. A package for enclosing an article, comprising:

a backing component having a porous board with a first sealing surface;

a film component of water soluble or water dispersible material having a second sealing surface, portions of the first surface of the backing component and the second sealing surface of the film component being sealed with one another with the article therebetween for creating at least one sealed area and at least one area containing the article;

an unsealed surface on the board interposed by the sealed area such that the unsealed surface is positioned to surround the article containing area for providing non-resistant peel away of the film from the board; and a pull-tab coupled to the film and extending beyond the board for assisting in non-resistant peel away of the film component from the board.

* * * * *